US005167195A

United States Patent [19]

Guerreschi

[11] Patent Number: 5,167,195

[45] Date of Patent: Dec. 1, 1992

[54] APPARATUS TO BE FITTED UP ON A CONVENTIONAL SEWING MACHINE FOR SIMULTANEOUSLY SEWING PARALLEL LINES OF STITCHES

[76] Inventor: Carlo Guerreschi, Via Campanile Vecchio, 15/A Ca' Di David, Italy

[21] Appl. No.: 787,759

[22] Filed: Oct. 4, 1991

Related U.S. Application Data

[63] Continuation of Ser. No. 528,909, May 24, 1990, abandoned, which is a continuation of Ser. No. 259,393, Oct. 18, 1988, abandoned, which is a continuation of Ser. No. 27,887, Mar. 19, 1987, abandoned.

[30] Foreign Application Priority Data

Apr. 9, 1986 [IT] Italy ..... 63246B/86[U]

[51] Int. Cl.[5] ..... D05B 25/00

[52] U.S. Cl. ..... 112/155; 112/163

[58] Field of Search ..... 112/155, 163, 164, 167, 112/181, 221

[56] References Cited

U.S. PATENT DOCUMENTS

| | | | |
|---|---|---|---|
| 447,880 | 3/1891 | Kern | 112/167 |
| 913,598 | 2/1909 | White | 112/167 |
| 1,578,324 | 2/1925 | Klau | 112/155 |
| 3,332,381 | 7/1965 | Dobner et al. | 112/181 X |
| 3,783,811 | 1/1974 | Schmedding et al. | 112/155 X |
| 4,043,283 | 8/1977 | Jung | 112/163 |
| 4,147,119 | 4/1979 | Dunn | 112/317 |
| 4,641,591 | 2/1987 | Draghicchio | 112/155 |

FOREIGN PATENT DOCUMENTS

| | | |
|---|---|---|
| 2027074 | 2/1980 | United Kingdom . |
| 2160236 | 12/1985 | United Kingdom . |

*Primary Examiner*—Werner H. Schroeder
*Assistant Examiner*—Paul C. Lewis
*Attorney, Agent, or Firm*—Theodore Jay

[57] ABSTRACT

The present apparatus (1) can be attached to a conventional sewing machine (2) and consists essentially of upper and lower frames. A needle bar unit (8) along with relative driving means is attached to the upper frame. A rotating hook (11) is attached to the lower frame. The upper frame and the lower frame are situated in front of and around a working head of a sewing machine (2) in order to cooperate with the head itself, there being thus the possibility of sewing double, parallel seams simultaneously. The needle bar unit (8) and the rotating, hook (11) are set in motion through secondary shafts (7, 10), which are connected through kinematic transmission belts (4,6) to a main driving pulley (3) of the complete sewing unit.

1 Claim, 1 Drawing Sheet

APPARATUS TO BE FITTED UP ON A CONVENTIONAL SEWING MACHINE FOR SIMULTANEOUSLY SEWING PARALLEL LINES OF STITCHES

This is a continuation application of Ser. No. 07/528,909, filed on May 24, 1990, now abandoned which is a continuation of Ser. No. 07/259,393, filed on Oct. 18, 1988, now abandoned, which is a continuation of Ser. No. 07/027,887 filed Mar. 19, 1987 now abandoned.

BACKGROUND OF THE INVENTION

The present invention is applicable to any conventional sewing machine capable of producing a single line of stitches and relates to an apparatus cooperating with the sewing machine and together producing simultaneously parallel lines of stitches.

In the known sewing machine art, using a conventional sewing machine capable of producing only a single line of stitches, in order to produce parallel lines of stitches for instance for producing belt loops or the like, it was necessary first to sew a line of stitches at one side of the material and then to shift the part already sewn and in a second operation of the sewing machine to sew the second line of stitches parallel to the first line. As it can be understood, this known procedure involved a considerable waste of time which affected the working costs of the manufacture greatly.

The purpose of the present invention is to eliminate the aforesaid disadvantage by using a simple arrangement which permits simultaneous sewing of parallel lines of stitches. Moreover, the present invention is very easy to use, and above all permits rapid sewing of the material because no tedious guiding of the material is necessary to maintain perfect parallelism of the two stitched seams. This object of the invention is obtained by coupling the present apparatus with a conventional sewing machine provided with a single needle.

In the following specification this invention is disclosed as applied to an apparatus fitted up on a conventional lock stitch sewing machine, it being understood that this invention may be similarly applied to any other known type of single needle sewing machines.

The device of this invention is characterized essentially by an upper supporting frame including a vertically reciprocating needle carrying bar, as well as a lower work supporting structure including a rotating hook; the needle carrying bar and hook being set in motion through secondary shafts controlled by suitable kinematic transmission gears which are connected to a main driving shaft of the sewing machine, the secondary shafts being mounted on the sewing machine itself. The sewing operation carried out by the ancillary apparatus thus obtained being coordinated to the sewing operation of the main sewing machine also by means of reduction gears; these reduction gears being interposed through toothed belts or similar joint means both between the needle carrying bar and its corresponding upper rotating shaft, and between the loop taker and its corresponding lower shaft.

The invention will be better understood from the following specification, which is an example not limiting the invention, as well as from the annexed drawing, in which.

Figure 1:
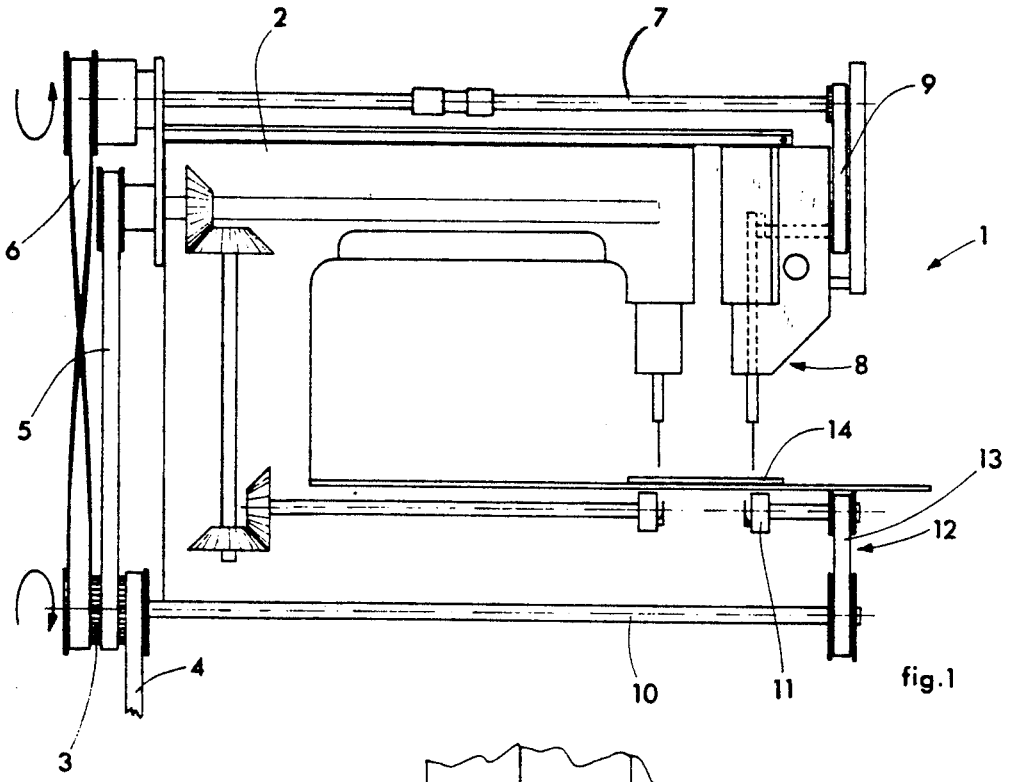
FIG. 1 shows a schematic side view of the invention as a whole.
Figure 2:
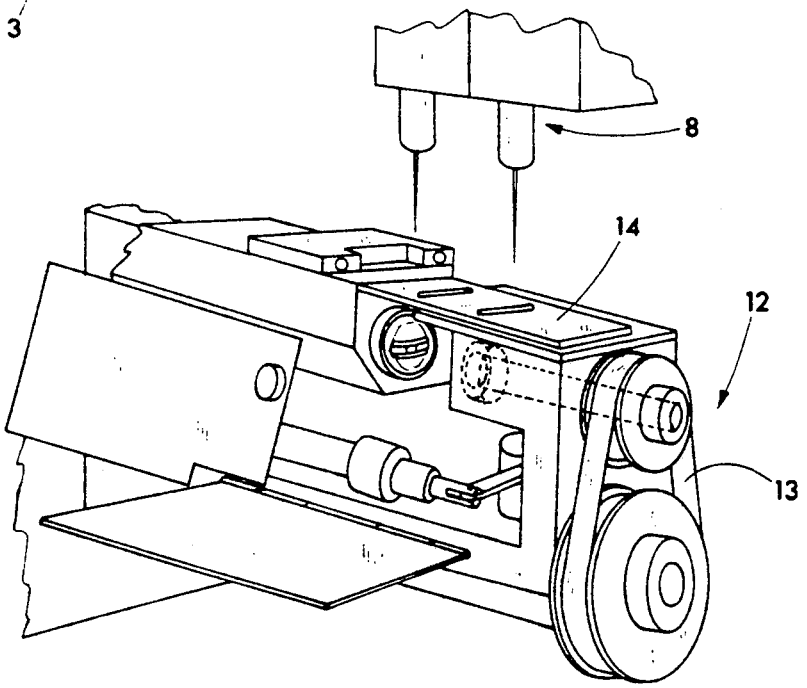
FIG. 2 shows a schematic perspective view of the lower work supporting structure showing the driving gears transmitting motion to the rotating hook.

With reference to the annexed drawings, number 1 generally denotes the apparatus of this invention mounted on a lock stitch sewing machine. The sewing machine, indicated with number 2, is operated by means of a main driving shaft 3, which is set in motion through a belt 4. The main driving shaft 3 has fast thereon a pair of belt driving gears one operating the conventional sewing machine and the other operating the ancillary apparatus 1.

More precisely, there is a belt 5 which sets in motion the gears of the sewing machine 2, and there is a belt 6 which imparts rotation in the opposite direction to a secondary shaft 7 provided for imparting motion to a reciprocating needle bar 8 of the apparatus 1 of this invention. In the present example, the belt 6 is mounted crossed so as to rotate the shaft 7 in a direction opposite that of the shafts of the sewing machine 2. The reciprocating needle bar 8 is set in motion by means of the shaft 7 through a kinematic unit 9, the gear ratio being 1:1. Moreover, the reciprocating needle bar 8 is positioned alongside the sewing needle of the conventional sewing machine 2, as it appears in FIG. 1.

On the lower work supporting structure there is provided a rotating hook 11 as well as operating means for the hook. The main shaft 3 imparts motion to the hook of the conventional sewing machine 2 as well as to a transmission shaft 10 for operating the hook 11 of the apparatus of this invention which is situated below the reciprocatory needle carrying bar 8 and cooperates with it in the formation of stitches. A driving gear set 12 connected through a toothed belt 13 permits motion to be transmitted from the shaft 10 to the hook 11, the gear ratio being 2:1.

The apparatus of this invention is so coordinated physically with the conventional sewing machine and is driven in such coordination therewith as to provide for the sewing of two parallel lines of stitches very quickly and without tedious guiding of the material being sewn. To adjust the apparatus to produce any desired width between parallel lines of stitching it is sufficient to insert between the conventional sewing machine 2 and the apparatus 1 of this invention a small throat plate 14 with needle accommodating apertures therein spaced apart a distance corresponding to the desired width between the parallel lines of stitches and then to align one aperture with the needle and hook of the conventional sewing machine, and align the needle 8 and hook 11 of the apparatus of this invention with the other aperture of the throat plate 14. The sewing may then be started to produce the desired spaced parallel line of stitches.

It will be understood that the ancillary apparatus 1 of this invention for providing rapid and precise parallel sewing is particularly advantageous in that it may be adapted for use with practically any conventional sewing machine. Since it is actuated by the same source as that of the sewing machine to which it is applied, the apparatus of this invention is compatible, for instance, with sewing machines having electronic needle positioning motors, pneumatic thread cutters, or any other known appurtenance.

I claim:

1. An apparatus adapted to be mounted on a sewing machine having a first head with a first reciprocating needle bar, a first needle on the first bar, a first rotating hook cooperating with the first bar and the first needle for the formation of a first line of stitches and further having a main driving shaft for said first bar and first hook, said apparatus including:

a second head with an upper supporting frame carried by said machine; a second reciprocating needle bar housed in the upper frame with a second needle on the second bar;

a second rotating hook supported in a lower structure carried by the machine cooperating with the second bar and the second needle for formation of a second line of stitches, the second head and second bar spaced apart by only a small air space from and being disposed adjacent the first head and bar, there being no structure of any kind disposed in said air space or disposed alongside of said space; and means for operating the second needle bar and second hook in coordination with the operating of the first bar and first hook, said means including secondary shafts mounted on the machine and driven by the main shaft through suitable kinematic transmission devices connected to the main shaft, said devices being selected from the group consisting of gears and belts, one of the secondary shafts being operatively connected through a reducing gear to said second hook.

* * * * *